US005249704A

United States Patent [19]

Boetzkes

[11] Patent Number: 5,249,704

[45] Date of Patent: Oct. 5, 1993

[54] SEALING CAP

[76] Inventor: Klaus Boetzkes, Heissstrasse 6, D 8940 Memmingen, Fed. Rep. of Germany

[21] Appl. No.: 944,186

[22] Filed: Sep. 11, 1992

[51] Int. Cl.[5] ..... B65D 41/32

[52] U.S. Cl. ..... 220/724; 220/275; 215/254; 215/256

[58] Field of Search ..... 220/270, 275, 724; 215/256, 254, 252

[56] References Cited

U.S. PATENT DOCUMENTS

| | | | |
|---|---|---|---|
| 4,470,513 | 9/1984 | Ostrowsky | 215/252 |
| 4,616,763 | 10/1986 | Ruhl | 220/724 X |
| 4,779,750 | 10/1988 | Armstrong | 215/254 |
| 5,029,718 | 7/1991 | Rizzardi | 215/254 |

FOREIGN PATENT DOCUMENTS

| | | |
|---|---|---|
| 0161565 | 11/1985 | European Pat. Off. . |
| 8617479 | 10/1986 | Fed. Rep. of Germany . |

*Primary Examiner*—Allan N. Shoap
*Assistant Examiner*—Paul A. Schwarz
*Attorney, Agent, or Firm*—Jacobson, Price, Holman & Stern

[57] ABSTRACT

A sealing cap, for use on the valve of a barrel having an opening with a collar and a valve sealing plate, is made of plastics and is of the type which is damaged during opening. The cap comprises a cover plate and a cylindrical guide. Locking elements are disposed on an inner side of said cylindrical guide, and, in use, engage resiliently under the collar such that the valve sealing plate covers said locking elements at the top, and said cylindrical guide covers said locking elements towards the outside. Narrow radially aligned webs are provided on one part of said cover plate, which webs frangibly connect said cover plate and said cylindrical guide.

6 Claims, 3 Drawing Sheets

SEALING CAP

BACKGROUND OF THE INVENTION

The invention relates to a plastic sealing cap for a valve of a barrel, comprising a cover plate and a cylindrical guide, disposed on the inner side of which are locking elements which engage resiliently under a collar on the container opening upon sealing, whereby the valve sealing plate covers the locking elements at the top and the sealing cap is damaged during opening.

Sealing caps for the valves of barrels have been disclosed in many forms. They have the function on the one hand of protecting the valve during transport and storage of the barrels and on the other hand act as a seal to prevent tampering with the valve.

EP-A-0,161,565 and DE-U-8,617,479 describe a plastics valve sealing cap of this kind for pushing onto a valve. Resilient locking elements, which engage under the valve plate when pushed onto the latter and which are designed so as to be damaged during opening are disposed laterally on a cylindrical guide. The locking elements are located in the region of windows on the cylindrical guide, so that they can be seen externally. In this manner, damage can be quickly ascertained.

This viability of the locking elements also means that they are accessible from the outside and may also be tampered with. This is often undesirable.

The object of the invention is therefore to provide a valve sealing cap of the abovementioned type, in which tampering is prevented but which can be easily removed from the valve after opening.

SUMMARY OF THE INVENTION

The present invention achieves this object in that it starts out from a sealing cap made of plastic, as described above, and proposes that the cylindrical guide covers the locking elements towards the outside, and that narrow radially aligned webs are provided on a part of the cover plate, which webs frangibly connect the cover plate and the cylindrical guide.

The locking elements are thus no longer accessible from outside and can no longer be bent backwards or otherwise tampered with in order to permit unnoticed opening of the valve. With this design, the cylindrical guide is firmly seated on the cover, which receives or surrounds the valve. There is thus also no possibility of access between the barrel cover and the lower edge of the guide.

Partial tearing off of the cylindrical guide from the cover plate is possible on account of the narrow webs provided on only a part of the cover plate. After tearing-off, the cover plate with the part of the cylindrical guide still attached to it and the separated part of the cylindrical guide can be easily removed, so that no remaining parts of the seal remain on the valve. This facilitates the connection of the barrel and also ensures that no troublesome parts remain in the area of the valve when the barrel is returned for cleaning and refilling. This considerably facilitates and speeds up the cleaning process.

It has been found to be favourable if the webs delimit windows on the cover plate. Since the sealing cap is manufactured by injection moulding, the tab-like locking elements can be moulded with simple tools which extend through the windows. In this embodiment, the windows are disposed essentially only in the cover plate and above the valve plate, so that the locking elements cannot be reached through the cylindrical guide.

Preferably the narrow webs are disposed on the larger part of the periphery of the cover plate, while the smaller part of the periphery of the cover plate has broad webs, which are connected to the cylindrical guide so that they cannot be torn off. A circular segment of about 110° for the area with the broad webs is foreseen. It is thus ensured that the part of the cylindrical guide remaining on the cover plate does not catch on the valve plate and can be stripped off by a simple manual movement. Both the broad and the narrow webs delimit windows in the cover plate, the narrow webs delimiting alternately a window with a locking element below and a window without a locking element.

If the narrow webs are sufficiently thin, they can be severed even in the absence of an additional point of narrowing.

In a preferred embodiment, the transition from narrow webs to broad webs is delimited by a slit having a connecting seam on the cylindrical guide Here, the slit runs axially parallel, like the seam, and the slit preferably connects with a window without a locking element. The seam is achieved with a simple narrowing at the lower edge of the cylindrical guide. At this point, during opening, the cylindrical guide with the narrow webs is torn off from the part of the cylindrical guide with the broad webs, which remains on the cover plate.

In another embodiment of the invention only one slit having a seam is provided. Upon tearing off, the cylindrical guide can be torn at this seam and also separated from the cover plate along the thinner webs. However, it remains connected to the other part of the cylindrical guide, which is bonded by the broad webs to the cover plate. This embodiment of the invention has the advantage that it makes clear that the sealing cap has been opened, but the separate parts of the sealing cap remain connected. In this design, the sealing cap can thus be used for return of the barrels for refilling and still has a protective function.

Here it is favourable if a thickened part is disposed on the lower edge of the cylindrical guide, which stiffens the cylindrical guide. After the tearing operation, it then remains approximately in the same position as before the tearing operation or springs back resiliently into this position.

In order to facilitate opening further, a gripping element is provided in the part of the cover plate having the narrow webs. This may be, for example, a flat shoulder on the cover plate. This is especially simple to manufacture, especially if there are no locking elements in the region of the gripping element. In order further to facilitate placement of the hand, an opening is provided on the cylindrical guide in the region of the handle element, which extends laterally somewhat beyond the handle element. Nevertheless, the cylindrical guide still remains a narrow part in the region of the handle element.

It is favourable for the locking elements to be stiffened with axially parallel ribs. This ensures that during opening, the locking elements are neither bent nor torn off. Rather, when the cover plate is raised at the gripping element, the sealing cap will break at the webs, and two parts will result, which are not, or no longer sufficiently, connected, so that the sealing cap cannot be used again. The cylindrical guide also has axially parallel ribs for stiffening, which for reasons of manufacture form the narrow webs, or delimit the broad webs, on the cover plate. The sealing cap of the invention is of particular utility with metal barrels or kegs of the kind used for the storage of drinks, e.g. beer.

DESCRIPTION OF PREFERRED EMBODIMENTS

Figure 1:
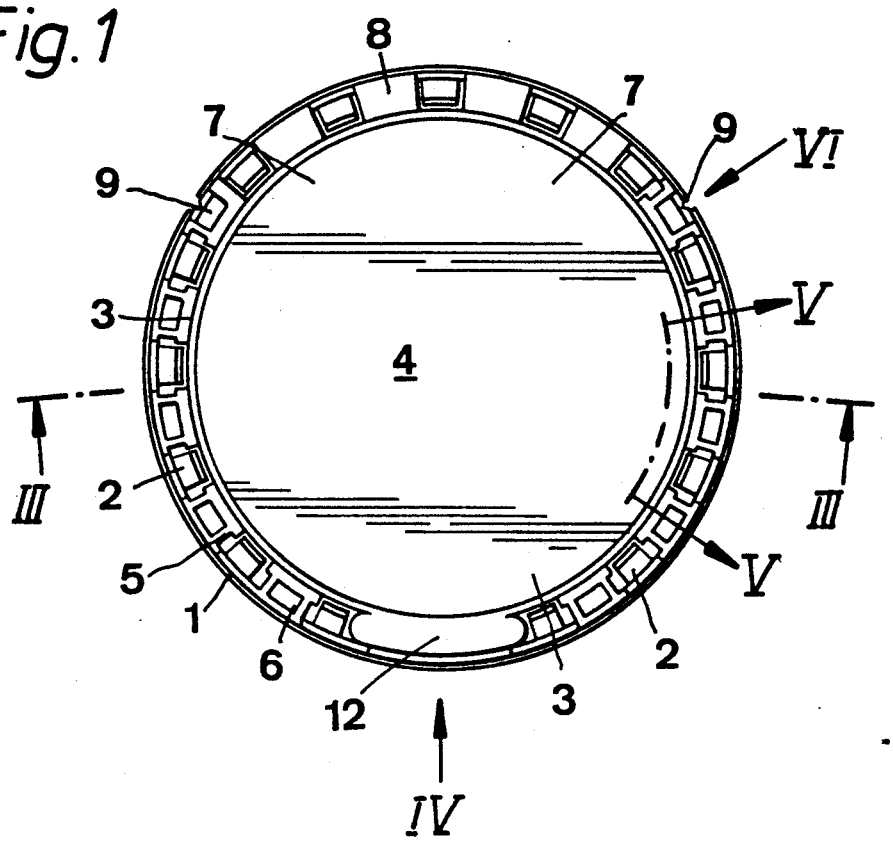
FIG. 1 shows a plan view of a sealing cap according to the invention.
Figure 2:
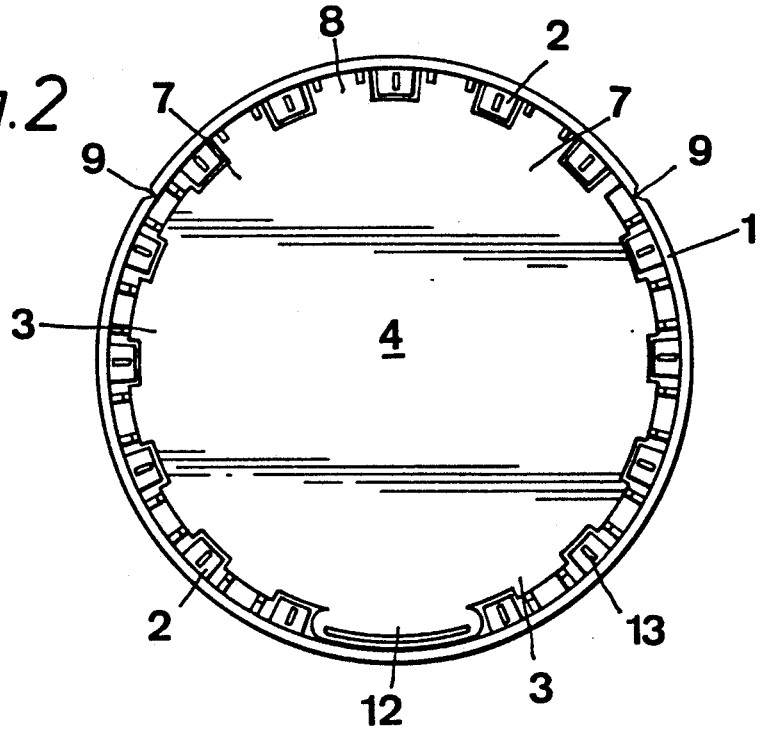
FIG. 2 shows a view of the underside of the sealing cap according to the invention.
Figure 3:
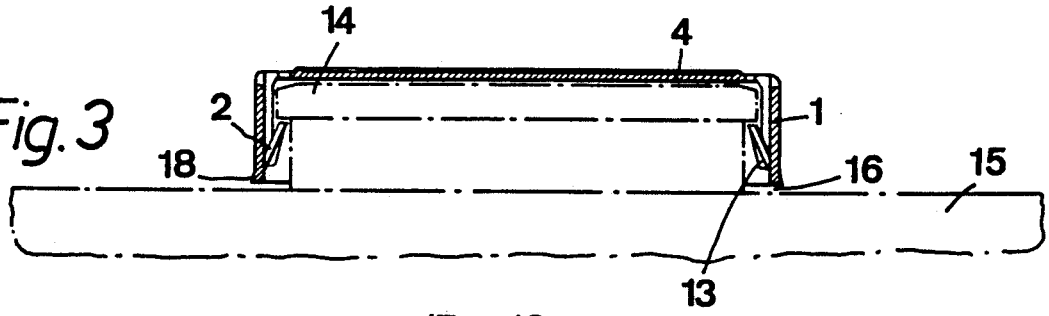
FIG. 3 shows a sectional view along the line III—III of FIG. 1.
Figure 4:
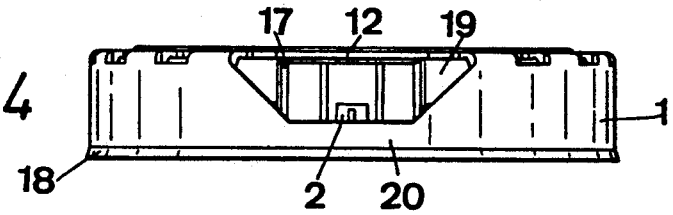
FIG. 4 shows a side elevational view of the sealing cap in the direction of the arrow IV of FIG. 1.
Figure 5:
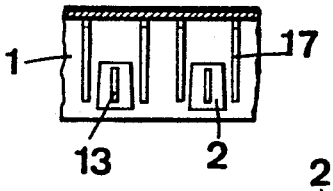
FIG. 5 shows a partly sectional view of a detail of the invention along the line V—V of FIG. 1.

Referring first to FIG. 1, a sealing cap comprises an essentially cylindrical guide 1 and a cover plate 4. Locking elements 2, which in use sit below the valve plate 14 on the barrel cover 15, are provided on the cylindrical guide 1. Valve plate 14 and barrel cover 15 are shown in FIG. 3 in broken lines. The space 16 between the lower edge of the cylindrical guide 1 and the barrel cover 15 is too narrow to permit tampering from the lower edge of the cylindrical guide 1.

Windows 6 are only provided in the cover plate 4 and not in the cylindrical guide 1. This makes tampering with the sealing cap even more difficult.

The windows 6 in the cover plate 4 are delimited around the larger part 3 of the periphery of the cover plate 4 by narrow webs 5. Window 6 having a locking element 2 below thus alternate with windows 6 without locking elements below. The smaller part 7 of the periphery of the cover plate 4 has webs 8, which have approximately the same width as a window 6. These webs 8 delimit windows 6 having locking elements 2 below. After opening, the part 7 of the cylindrical guide 1 having the broader webs 8 remains attached to the cover plate 4. The circular segment having the broader webs 8 has an angle of arc of approximately 110°. It has been found that with this angle the torn-off sealing cap does not adhere to the valve flange, nor does the cylindrical part catch on the valve. This eliminates laborious preparation before cleaning and refilling of the barrels.

The locking elements 2 having axially parallel reinforcing ribs 13 and are essentially disposed at an acute angle on the cylindrical guide. The cylindrical guide 1 also has axially parallel ribs 17, which form the narrow webs 5 at part 3 of the cover plate 4. At part 7 of the cover plate 4 they are used for reinforcing the broader webs 8.

The junction 9 between the part 3 and the part 7 of the cover plate 4 is characterised on the cylindrical guide 1 by a slit 10 and a seam 11. Slit 10 and seam 11 are here preferably also axially parallel and facilitate severance of the cylindrical guide 1.

Figure 6:
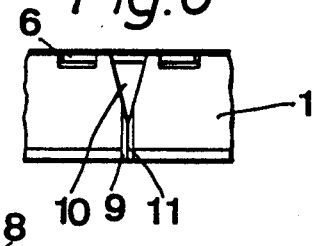
FIG. 6 shows a side view of a further detail of the invention in the direction of the arrow VI of FIG. 1.
Figure 7:
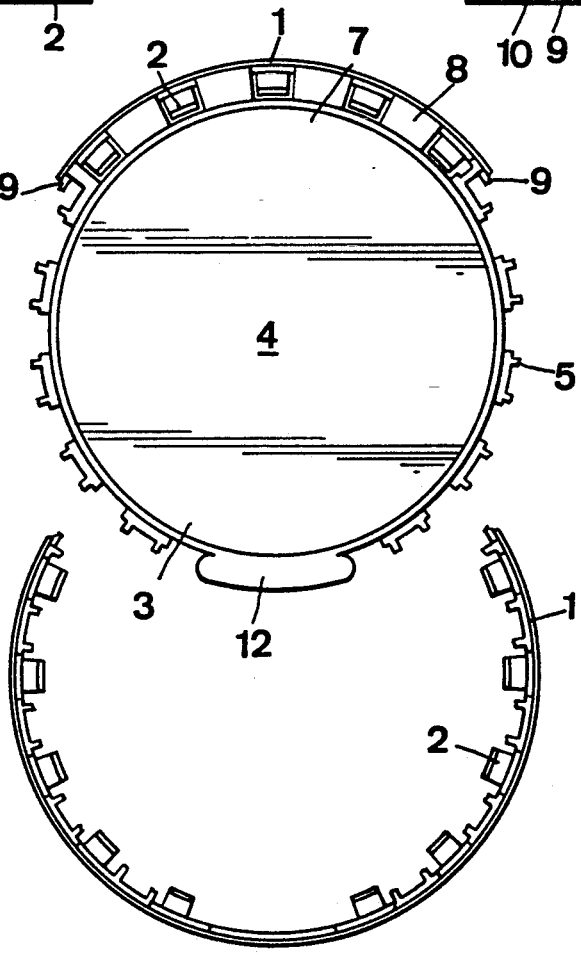
FIG. 7 shows a plan view of an opened sealing cap.

In FIG. 6 it can be seen that the slit 10 has a wedge-shaped connection with a window 6 and terminates in the seam 11, which is formed by a thinning in the material in the cylindrical guide 1. The thinning continues into the otherwise slightly thickened lower edge 18 of the cylindrical guide 1.

To facilitate opening of the sealing cap, a grip 12 is provided approximately in the centre of the part 3 on the periphery of the cover plate 4. The grip 12 consists, for example, of a narrow shoulder, which is moulded on the cover plate 4. In the region of the grip 12, the cylindrical guide 1 has no locking elements. The cylindrical guide 1 is provided with an opening 19 in the area of the grip 12, so that the grip 12 can be more easily grasped. The opening 19 project laterally somewhat beyond the grip and is delimited at the bottom by a narrow strip 20, which here forms the cylindrical guide 1.

Figure 8:
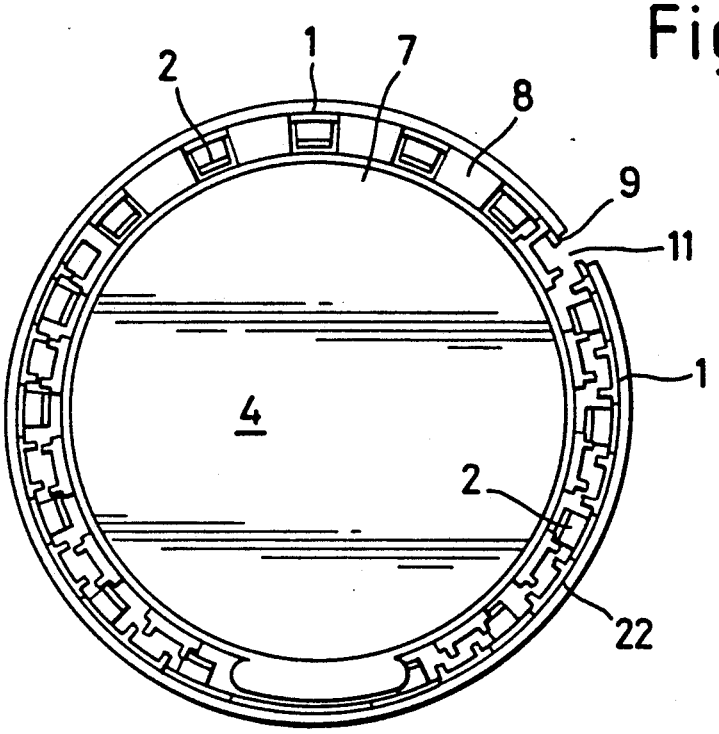
FIG. 8 shows a plan view of a modified embodiment of the invention.

FIG. 8 shows an exemplary embodiment of the invention in which the tearable part 22 of the cylindrical guide remains partly connected with the other part of the cylindrical guide 1. There is achieved by providing only a single seam 11.

Figure 9:
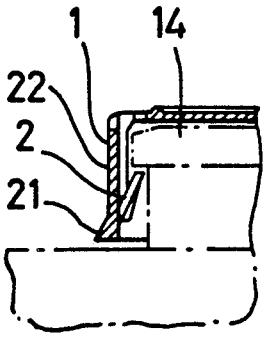
FIG. 9 shows a section through a part of the cover plate of the embodiment of FIG. 8.

From FIG. 9 it can be seen that with this design it is advisable to provide a thickened part 21 on the lower edge of the cylindrical guide 1. This thickened part stiffens the tearable part and ensures an increased spring force, so that the torn-off part 22 does not gape open during use.

I claim:

1. A plastic sealing cap for a valve of a container with an opening having a collar and a valve sealing plate, the cap being of the type which indicates being opened or tampered with, the cap comprising:

a cylindrical guide;

a cover plate having a periphery defined by a major part and a minor part, the minor part of the periphery of said cover plate having broad webs which are connected to said cylindrical guide so that they cannot be torn off, wherein a junction between said major and minor parts is delimited by a slit having a single connecting seam formed in the cylindrical guide, the seam being disposed between said major and minor parts in such a manner that a torn-off portion of said cylindrical guide remains unconnected on one side to a part of said cylindrical guide which in not torn off;

locking elements disposed on an inner side of said cylindrical guide, which, in use, engage resiliently under the collar, the locking elements being covered from above by the valve sealing plate and being covered on sides by said cylindrical guide;

narrow radially aligned webs disposed around the major part of the periphery of said cover plate, which webs frangibly connect said cover plate and said cylindrical guide and delimit windows in the cover plate.

2. A sealing cap according to claim 1, wherein a gripping element is provided in said major part of said cover plate.

3. A sealing cap according to claim 1, wherein said locking elements are stiffened by axially parallel ribs.

4. A sealing cap according to claim 1, wherein said windows are disposed on said cover plate in the region of said locking elements on said cylindrical guide.

5. A sealing cap according to claim 1, wherein said windows are disposed essentially only in said cover plate.

6. A sealing cap according to claim 1, wherein said cylindrical guide has a stiffening thickened part on a lower edge thereof.

* * * * *